United States Patent [19]

Hamlett

[11] 3,978,802

[45] Sept. 7, 1976

[54] SEWING MACHINE THREAD TENSIONER

[75] Inventor: Sidney J. Hamlett, Parma, Ohio

[73] Assignee: White Sewing Machine Company, Cleveland, Ohio

[22] Filed: Nov. 8, 1974

[21] Appl. No.: 521,956

[52] U.S. Cl. ..... 112/254

[51] Int. Cl.[2] ..... D05B 47/02

[58] Field of Search ..... 112/254, 255

[56] References Cited

UNITED STATES PATENTS

| | | | |
|---|---|---|---|
| 1,569,992 | 1/1926 | McCann | 112/254 X |
| 2,652,017 | 9/1953 | Hohmann | 112/255 |
| 2,730,061 | 1/1956 | Czajkowski | 112/254 |
| 2,993,456 | 7/1961 | Herbst | 112/254 |
| 3,190,249 | 6/1965 | Gegauf | 112/254 |
| 3,557,731 | 1/1971 | Casas-Robert | 112/254 |
| 3,628,480 | 12/1971 | Van Ness | 112/255 |
| 3,667,414 | 6/1972 | Illes et al. | 112/254 |
| 3,785,309 | 1/1974 | Ketterer | 112/254 |
| 3,792,674 | 2/1974 | Casas-Robert | 112/254 |

*Primary Examiner*—George H. Krizmanich
*Attorney, Agent, or Firm*—McNenny, Pearne, Gordon, Gail, Dickinson & Schiller

[57] ABSTRACT

A tensioner unit in a thread supply path for a domestic sewing machine which by its structural arrangement and location on an upper face of a machine provides a feed path across the frontal face of the machine for full visibility and accessibility of the thread without obstructing the view of the work area. The feed path through the tensioner unit is also arranged to provide a wrap of thread through the unit about a vertical axis in excess of 180 degrees to provide stable frictional engagement of the thread in the tensioner unit.

2 Claims, 4 Drawing Figures

LOOSE NORMAL

SEWING MACHINE THREAD TENSIONER

BACKGROUND OF THE INVENTION

The invention relates to a thread supply path in a sewing machine and, in particular, relates to improvements in thread tension and guide means for a thread supply path in a domestic sewing machine.

PRIOR ART

Conventional thread tensioner devices have been provided with a manually controllable knob or other element for selectively adjusting the load on a biasing spring to effect a desired change of frictional drag on the thread. Since adjustments are routinely made by the machine user to satisfy particular sewing conditions, it is desirable that the tension control element be in convenient view and reach of the user. Among various known arrangements in the prior art is the mounting of the tensioner device on the front face of the sewing machine. This arrangement provides a high degree of visibility and accessibility for the tensioner unit itself and permits the thread path to be advantageously directed over the frontward face of the sewing head so that the thread guides to the needle are also in full view and access. In some cases, though, a forwardly disposed tension device has obstructed the view of portions of the work area at least along a nearly vertical line of sight.

One approach for maintaining a frontal thread path while avoiding visual obstruction of the work area by a thread tensioner device is disclosed in U.S. Pat. Nos. 3,190,249 and 3,347,195, both of Gegauf, where the tensioner device is mounted entirely within the sewing head housing. With such an arrangement, it is difficult to provide a thread path which wraps sufficiently around a core of the tensioner unit to ensure stable frictional engagement of the thread.

The prior art includes the following patents:

345,581 — Fleharty
477,078 — Stewart
485,546 — Hunt
553,347 — LaRue
1,014,050 — Davis
2,526,482 — Hohmann
2,609,773 — Nelson
2,937,605 — Dunn et al.

SUMMARY OF THE INVENTION

The invention provides a thread tensioner device in a thread path of a domestic sewing machine which, by its position and its structural arrangement, provides an unobstructed view of the work area, affords a frontal thread path to the needle, and develops substantial wrap of the thread in the device to ensure stable frictional thread engagement. In accordance with the invention, the tensioner device is disposed on the upper face of the machine adjacent the head end of the arm. Thread is directed longitudinally of the arm from a spool, mounted at the standard end of the machine, to the tensioner unit. The thread passes arcuately around a central core of the tensioning unit about a vertical axis toward the front of the machine and downwardly across the frontal face of the sewing head to the needle.

In the illustrated embodiment, the tensioner device comprises a plurality of spring-biased friction discs stacked on a central vertical shaft. The device is disposed adjacent the presser foot bar with the central shaft responsive to vertical movement of the bar for automatically releasing tension on the thread when the presser foot is lifted. As disclosed, the tensioner device is a self-contained subassembly which includes a guide means for directing a thread through a wrap angle around the central shaft substantially in excess of 180°. Preferably, an intermediate disc is disposed between a pair of opposed friction discs to provide separate paths through the device for each thread, one on each face of the intermediate disc, during double needle sewing.

DESCRIPTION OF THE PREFERRED EMBODIMENT

Figures 1, 2, 3, 4:
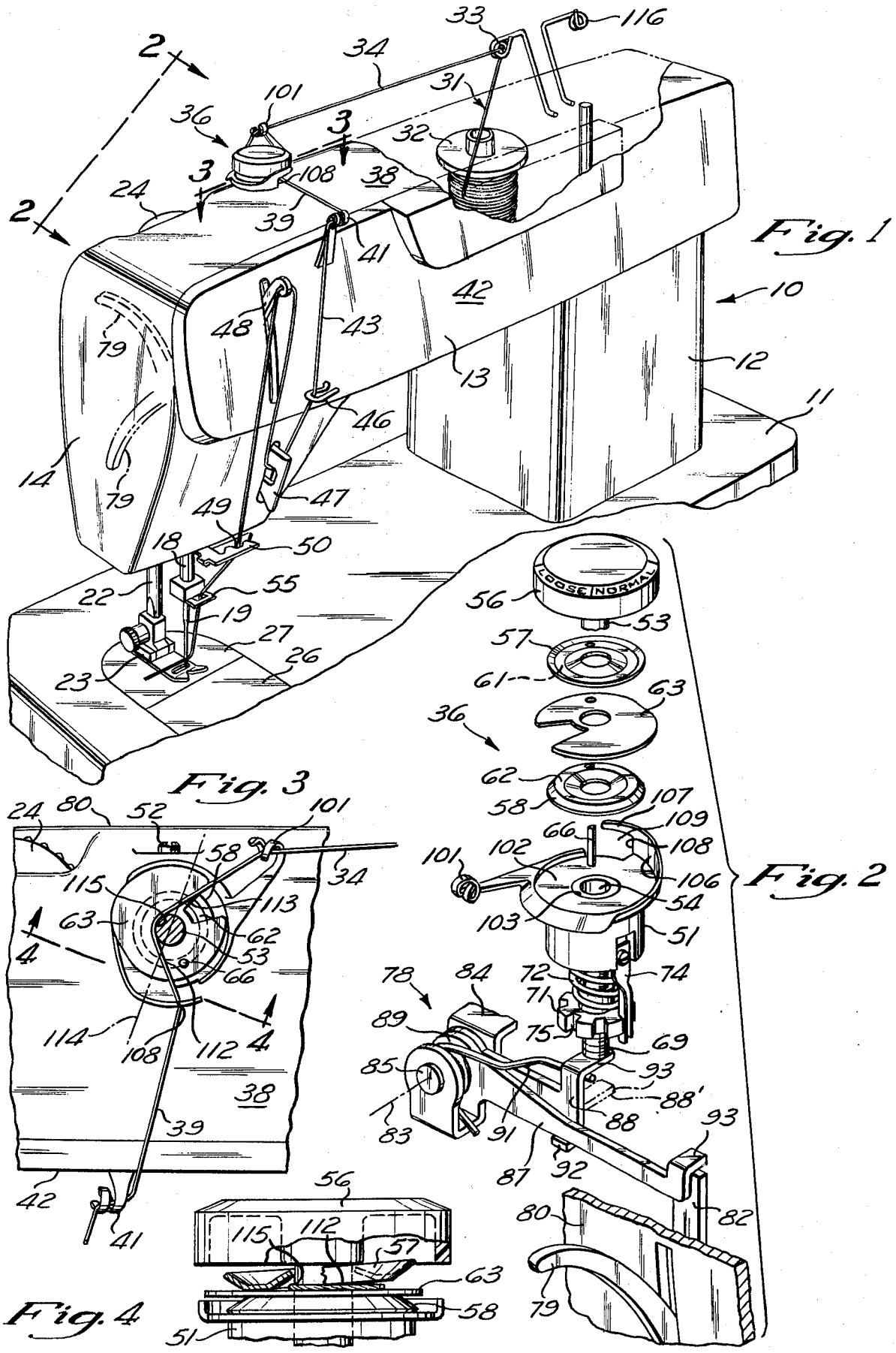
FIG. 1 is a perspective view of a sewing machine incorporating the principles of the invention.
FIG. 2 is a perspective view, taken along the line 2—2 of FIG. 1, of a tensioner device of the invention, with its elements shown exploded along a vertical axis.
FIG. 3 is a sectional view of the tensioner unit, taken along the line 3—3 shown in FIG. 1.
FIG. 4 is an elevational view of the tensioner device on an enlarged scale.

There is shown in FIG. 1 a conventional domestic lockstitch sewing machine 10 having a base plate 11, a standard 12 extending vertically from the base plate, an arm 13 extending horizontally from the standard, and a sewing head 14 at the free end of the arm. A needle bar 18, supporting a needle 19, is vertically reciprocated by conventional means (not shown) within the arm 13 and standard 12 during sewing operation. Immediately to the rear of the needle bar 18 is a presser bar 22 on which a presser foot 23 is secured. The presser bar 22 is biased downwardly by a spring (not shown) which is adjustably tensioned in a known manner by a control knob 24 rotatably mounted in the sewing head. The presser bar holds down fabric in a work area generally defined by a pair of removable plates 26 and 27 mounted on the bed plate 11.

Thread 31 is fed from a supply spool 32 generally along the vertical axis of the spool. The thread 31 changes direction at a wire eyelet guide 33, substantially in vertical alignment with the axis of the spool 32, and forms a horizontal reach 34 to a thread tensioner unit 36. The horizontal reach 34 is generally withing a plane definced by an upper face 38 of the arm 13. The path of the thread 31 is diverted at the tensioner unit 36 from the longitudinal direction of the rearward horizontal reach 34 forwardly over the upper face 38 of the arm in a generally horizontal reach 39. An eyelet guide 41 extending from a frontal face 42 of the machine allows the thread 31 to be turned downwardly across this frontal face in a vertical reach 43. The vertical reach 43 enters a wire loop guide 46 from which the thread 31 is directed to a regulator bracket 47 and then to a takeup lever 48. From the takeup lever 48, the thread extends downwardly to one notch 49 of a guide bracket 50 and then through a guide aperture 55 on the needle bar 18 to the needle 19.

Referring in particular to FIG. 2, the tensioner unit 36 includes a cylindrical body 51 received in a cylindrical bore (not shown) formed in a machine cover forming the upper face 38 of the arm. The body 51 is fixed within this upper face cover by a setscrew 52 (FIG. 3). A central vertical shaft or core 53 is rotatable and axially slidable in a cylindrical axial bore 54 of the body 51. A manually controlled knob 56 is fixed to the upper end of the shaft 53. Assembled on the shaft 53 between the body 51 and knob 56 are a pair of opposed friction washers or discs 57 and 58 having embossed or raised circular friction surfaces 61 and 62, respectively. A flat washer or disc 63 is assembled on the shaft 53 between the opposed washers 57 and 58.

A vertical pin 66 is pressed or otherwise fixed to the body 51 eccentric of the central bore 54. The pin extends through holes in the washers 57, 63, and 58 and a circumferential groove (not shown) of just short of 360° in the underside of the knob such that the pin 66 prevents relative rotation of the washers on the body 51 and limits rotation of the knob 56 to about 340° relative to the body. A lower end 69 of the central shaft 53 is threaded to receive a tension adjusting nut 71. A helical compression spring 72 is interposed between the nut 71 and body 51 concentrically about the shaft 53. It can be seen that compressive force in the spring 72, by action on the nut 71, urges the shaft 53 downwardly and, by action of the knob 56 against the upper washer 57, causes the washer faces 61 and 62 to resiliently abuttingly engage the intermediate washer 63.

For initial tension adjustment, a spring finger 74 secured to the body 51 by a screw is deflected radially outwardly from the nut 71 to permit turning of the nut, and is then released into an appropriate notch 75 on the periphery of the nut. This initial adjustment is made prior to installation of the tensioner unit 36 on the machine 10. To suit a particular sewing condition, the knob 56 is manually rotated in one direction or another to cause the nut to be moved towards or away from the body 51 to increase or decrease the biasing force on the spring 72, and therefore the drag on the thread 31.

An over travel mechanism 78 (FIG. 2) is provided to release the tension force of the spring 72 on the abutting friction discs 57, 63, and 58 upon lifting of the presser foot bar 22. A manual release lever 79 extending outwardly from a rear face 80 of the sewing head 14 is connected (by means not shown) to the presser foot bar 22 such that the bar is lifted as the lever is moved to the position illustrated in FIG. 2. An upstanding bracket arm 82, fixed to the presser foot bar 22, actuates the mechanism 78 to release the tensioner unit 36. The over travel mechanism 78 is concealed from view within the arm 13 and is supported on a bracket 84 fixed to an internal portion of the machine 10.

A pair of levers 87 and 88 are pivotally supported about a horizontal axis 83 transverse to the longitudinal direction of the arm 13 on a horizontal pin 85 fixed to the bracket 84. The first lever 87 is arranged to drive the second lever 88 from a retracted position indicated in phantom at 88' through a relatively stiff spring 89 coiled about the pin 85. An arm 91 of the spring 89 biases the lever 88 upwardly or counterclockwise relative to the adjacent arm 87. Movement of the second or shorter lever 88 relative to the extended arm 87 is limited by a tab 92 engaging the underside of the latter arm. Lifting of the control lever 79 to release the presser foot 23 causes the bracket arm 82 to engage a tab 93 integral with the lever 87 to move the same upwardly or counterclockwise. This movement is followed directly by the shorter lever 88, whereby motion of an offset tab 93 produces vertical movement of the tensioner shaft 53 and release of force of the compression spring 72 on the friction washers 57, 63, and 58.

Where movement of the control lever 79 is excessive, as when it is desired to completely raise the presser foot 23 to an uppermost position, the spring 89 yields so that the secondary lever 88 does not follow the full motion of the arm 87. It will be appreciated that such an arrangement is advantageous because the tension in the device 36 is releases relatively early in the motion sequence of the presser foot bar 82, transmitted by the extension bracket 82. Thus, full movement of the control lever 79 is not necessary to fully release the tensioner unit 36.

Fixed on the body 51 is a guide eyelet 101 integrally formed on a sheet metal stamping 102. The stamping 102 is permanently joined to the body by upsetting a body flange 103 over an aperture in the stamping. Diametrically opposite the guide eyelet 101 there is formed an integral axially extending flange segment 106. Projecting from this flange segment 106 is a guide finger 107. The finger 107 extends circumferentially from a flange edge 108 to hold thread down into engagement with the edge as viewed in FIG. 3. As seen in FIG. 3, the guide points formed by the eyelet 101 and edge 108 are within the planes of the forward and rearward faces 42 and 80 of the machine arm 13. The control knob 56 is proportioned such that its periphery is radially within these guide points 101 and 108.

The thread guide 108 is arranged relative to the central shaft 53 to deflect the thread segment therebetween of the upper reach 39 slightly horizontally toward the standard end of the machine so that with the guide 101 a thread wrap about the central shaft 53 substantially in excess of 180° is produced. This relatively large angle of wrap produces a stable condition for the thread wherein any tilting of the friction discs 57, 63, or 58 tends to bias the thread towards the central shaft or core 53 rather than to bias the thread away from the shaft and from between the washers. More specifically, the angle of thread wrap causes the thread to engage the embossed flat surface 61 or 62 of the particular washer which it contacts at points 112 and 113 (FIG. 3), which both lie on a common side, opposite an arc 115 of thread contact with the shaft 53 of an imaginary 53 and line 114 drawn through the axis of the shaft 53 aligned with the tangent of the arc 115 of contact. As illustrated in FIG. 4, the axial compressive forces between the discs 56, 63, and 58 may cause one of them to tilt towards the others at the side of arcuate contact 115 by pivoting on the points 112 and 113. As a result, the thread 31 does not have a tendency to work itself away from the shaft 53 and from between the discs.

It may be visualized that this stability is not lost when a second thread is fed from a second supply spool, through an eyelet 116 parallel to the reach 34 of the first thread 31, through the tensioner device 36, and then parallel with the first thread to a second needle during double needle sewing. The second thread is fed through the tensioner device 36 on a side of the intermediate disc 63 opposite the first thread 31 and is guided through an arc coextensive with the arc 115 by the guides 101 and 108.

The disclosed arrangement of the tensioner unit 36 in the thread path from the supply spool to the needle is particularly advantageous, since it enables the thread to be directed through the tensioner unit through an angle substantially greater than 180°, and therefore in a stable condition, without requiring the thread to conform to a tortuous or exceptionally complicated feed path. At the same time, the disclosed arragement provides a frontal thread path to the needle but does not obstruct the view of the work area.

While I have described my invention in connection with specific embodiments thereof, it is to be clearly understood that this is done only by way of example, and not as a limitation to the scope of my invention as set forth in the objects thereof and in the appended claims

What is claimed is:

1. In a sewing machine having a bed plate, a standard extending upwardly from the plate, an arm extending from the standard horizontally over the bed plate to a head, said head being supported by said arm immediately above a work area on the bed plate, said head supporting a needle bar, a thread tensioner device mounted on the upper face of the arm at the head end thereof, thread guide means for directing thread from a supply adjacent the standard and generally below an upper face of the arm through the tensioner device and ultimately to a needle, said tensioner device including means for turning thread in an arc about a vertical axis, means for frictionally engaging portions of the thread in said arc including a pair of friction washers and a spring biasing said washers into abutting contact, said guide means including a pair of guide points for wrapping said thread in said tensioner device about an arc measured on said washers in excess of 180°, whereby said washers are adapted to tilt on said thread to a stable thread-engaging position, said tensioner device and said pair of guide points being a self-supporting subassembly on said head end of said arm, said friction washers and said guide points being disposed above the plane of the upper face of the arm, each of said guide points being adjacent said tensioner device and each having associated therewith means for restraining the thread from movement vertically upward from the plane of the washers, one of said guide points deflecting thread from said thread turning means slightly towards said standard to produce said arc in excess of 180°, said guide means including means for directing thread from said one guide point forwardly over the upper face of the head and downwardly over a frontal area of the head to a needle on said needle bar.

2. A sewing machine as set forth in claim 1, wherein said guide means includes a guide point at the standard end of the arm arranged to direct thread axially upwardly from a spool disposed behind the standard and below the upper face of the arm to the other of said pair of guide points.

* * * * *

UNITED STATES PATENT AND TRADEMARK OFFICE

CERTIFICATE OF CORRECTION

PATENT NO. : 3,978,802

DATED : September 7, 1976

INVENTOR(S) : Sidney J. Hamlett

It is certified that error appears in the above-identified patent and that said Letters Patent are hereby corrected as shown below:

Column 1, under the heading PRIOR ART, Line 33, after the words 3,347,195, both, CHANGE "of" to -- to --.

Column 4, Line 40, after "imaginary" insert -- horizontal --.

Column 4, Line 40, after "imaginary" delete "53 and" .

Column 4, Line 41, after "the shaft 53" insert -- and -- .

Signed and Sealed this

Twenty-third Day of November 1976

[SEAL]

*Attest:*

RUTH C. MASON
*Attesting Officer*

C. MARSHALL DANN
*Commissioner of Patents and Trademarks*